United States Patent [19]

Marino

[11] 4,253,213

[45] Mar. 3, 1981

[54] PAINT BRUSH

[75] Inventor: Frank Marino, Baldwin, N.Y.

[73] Assignee: The Wooster Brush Company, Wooster, Ohio

[21] Appl. No.: 17,690

[22] Filed: Mar. 5, 1979

[51] Int. Cl.[3] ..... A46B 3/06

[52] U.S. Cl. ..... 15/192; 15/204; 16/108

[58] Field of Search ..... 15/159 R, 190, 192, 15/204, 205; 16/108, 109

[56] References Cited

U.S. PATENT DOCUMENTS

| | | | |
|---|---|---|---|
| 700,050 | 5/1902 | Humphrey | 15/204 |
| 1,280,050 | 9/1918 | Lee | 16/108 |
| 1,695,124 | 12/1928 | Reese | 15/192 |
| 3,155,998 | 10/1964 | Hardman et al. | 15/192 |
| 3,871,048 | 3/1975 | Leigh | 15/204 X |

FOREIGN PATENT DOCUMENTS

| | | | |
|---|---|---|---|
| 1187222 | 2/1965 | Fed. Rep. of Germany | 15/192 |

*Primary Examiner*—Christopher K. Moore
*Attorney, Agent, or Firm*—Maky, Renner, Otto & Boisselle

[57] ABSTRACT

A paint brush including a ferrule having a serrated skirt portion providing ribs and grooves which orient the bristle filaments and eliminate any gaps between the bristles and the ferrule. The serrated skirt portion may also slope inwardly and interact with a spacer member to help hold the bristles in the desired oriented condition.

6 Claims, 5 Drawing Figures

PAINT BRUSH

BACKGROUND OF THE INVENTION

This invention relates generally as indicated to a paint brush construction, including particularly the ferrule of the brush which assists in maintaining the brush bristles in a desired oriented position without gaps between the bristles and ferrule.

Heretofore, paint brush constructions have been provided with ferrules having inturned flanges for retaining the bristles and the block of adhesive inside the ferrule and for preventing radial outward divergence of the brush bristles in the outer periphery. Also, interlocking ridges and depressions have been provided in the ferrule located in positions where the adhesive material retaining the bristles may flow to further secure the bristle knot in the ferrule.

The brush construction of the present invention includes a modified ferrule arrangement to help orient the bristle filaments and eliminate any gaps between the ferrule and bristle.

SUMMARY OF THE INVENTION

With the foregoing in mind, it is a principal object of this invention to provide a paint brush construction in which the bristles are maintained in oriented positions to prevent gaps forming between the ferrule and bristles.

Another object is to provide such a brush construction including a ferrule with a serrated skirt portion for engagement with the bristles to hold the bristles in oriented positions.

Yet another object is to provide such a brush construction in which there is interaction between a spacer member and the skirt of the ferrule to help hold the bristles in oriented positions.

These and other objects of the present invention may be achieved by providing a serrated skirt portion on the ferrule to help orient the bristle filaments and eliminate any gaps between the ferrule and the bristle. The ferrule holds a bristle body with ends bonded together by an adhesive and has a skirt with ribs and grooves parallel to the bristles on the inner surface. The skirt may also have inwardly sloping surfaces interacting with a spacer member inset from the edge of the ferrule to further assist in holding the bristles in the desired oriented condition.

To the accomplishment of the foregoing and related ends, the invention, then, comprises the features hereinafter fully described and particularly set forth in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
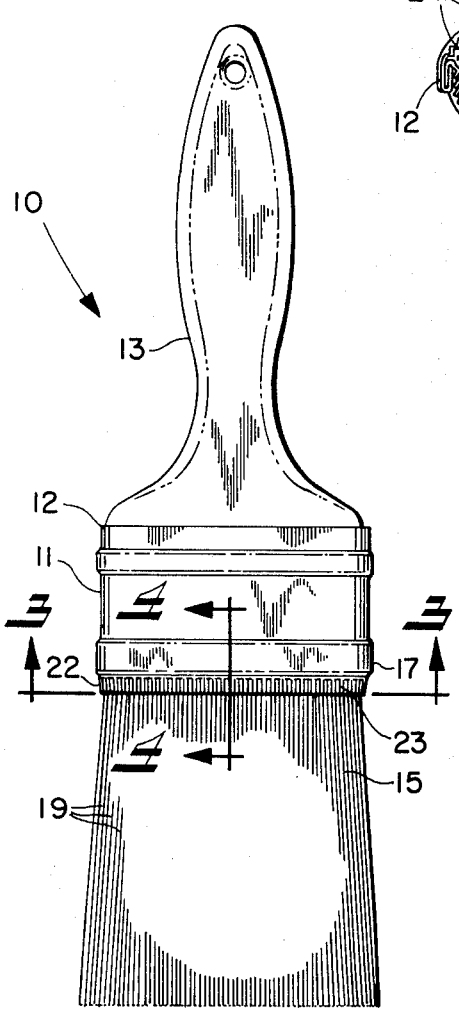
FIG. 1 is a front elevation view of a preferred form of paint brush embodying the present invention.

Referring now in detail to the drawings, a preferred form of paint brush 10 in accordance with this invention is shown having a tubular member of ferrule 11 which may be of sheet metal and connected along one edge as by means of a lap joint 12. A handle 13 is shown attached to a first end 14 of the ferrule 11 as by inserting the handle in the opening within the ferrule and fastening the ferrule to the handle by nails or other suitable means.

Figure 3:
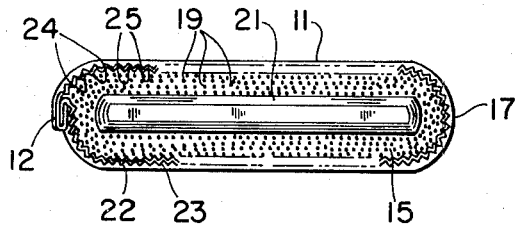
FIG. 3 is an enlarged transverse section through the brush of FIG. 1, taken along the plane of the line 3—3 thereof.
Figure 4:
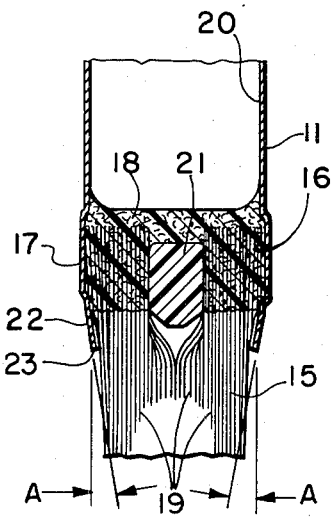
FIG. 4 is an enlarged fragmentary longitudinal sectional view through the brush of FIG. 1, taken along the plane of the line 4—4 thereof.

A bristle body 15 having a butt or root end 16 is mounted in a second end 17 of the ferrule 11. The bristle ends may be bonded together by a suitable adhesive material or cement 18 forming a body of material which may be vulcanized or otherwise hardened into a substantially rigid block which is not only adhered to the bristles 19 of the bristle body 15 but also may be adhered to the inner surface 20 of the ferrule 11. As shown in FIGS. 3 and 4, a spacer member 21 of plastic or other suitable material may be positioned spaced from the inner surface 20 of the ferrule 11 and inset from the edge of the second end 17 of the ferrule so that the bristles 19 are positioned between the spacer member and ferrule. The spacer member 21 may also be adhered to the bristle body 15 by the adhesive material.

Figure 2:
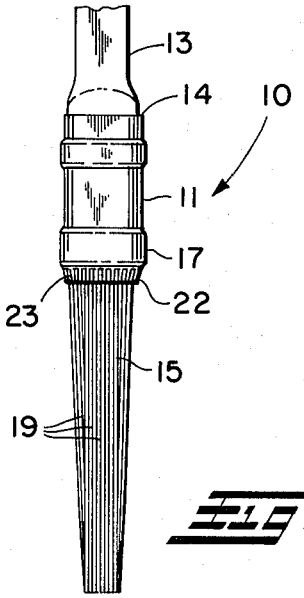
FIG. 2 is a partial side elevation view of the brush of FIG. 1.
Figure 5:
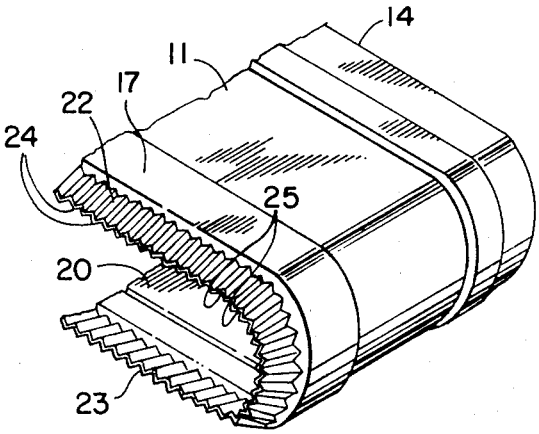
FIG. 5 is an enlarged fragmentary perspective view of the ferrule for the brush of FIG. 1.

As best seen in FIGS. 1 through 3, the bristles 19 of the bristle body 15 extend in generally parallel relationship and in a generally longitudinal direction relative to the ferrule 11. A skirt member 22 is provided at the second end 17 of the ferrule 11 and has serrations 23 along the outer edge thereof. The serrations 23 provide ribs 24 and grooves 25 on the inner surface 20 of the skirt member which are generally parallel to the bristles 19 and extend in a direction generally longitudinally of the tubular ferrule 11, thus assisting in maintaining the bristles 19 in parallel relationship. This bristle-retaining construction may be further supplemented by the interaction between the outer edge of the skirt member 22, which may be sloped inwardly at an angle A of around 5 to 10 degrees, and the spacer member 21 between which the bristles 19 are confined. In this manner, the parallel orientation of the bristles 19 of the bristle body 15 is maintained and the formation of gaps between the bristles and ferrule 11, which are a result of disoriented bristles, is substantially reduced or eliminated.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed or defined as follows:

1. A paint brush comprising a tubular ferrule, a bristle body having longitudinally extending bristles, said tubular ferrule having a first end surrounding the bristles and a second end for attachment to a paint brush handle, a skirt at said first end of said tubular ferrule having an inner surface for engagement with said bristles, and parallel ribs and grooves on said inner surface extending in a direction longitudinally of said tubular ferrule for orienting said bristles and preventing the formation of gaps between said bristles and said ferrule, said inner surface of said skirt being sloped inwardly away from the handle to provide increased engagement of said ribs and grooves with said bristles which extend from said first end of said tubular ferrule.

2. A paint brush comprising a tubular ferrule having a first end and a second end, a bristle body having bristles surrounded by said first end of said ferrule, a handle attached to said second end of said ferrule, a skirt at said first end of said ferrule, and ribs and grooves on an inner surface of said skirt extending parallel to said bristles for orienting the bristles of said bristle body and preventing the formation of gaps between the bristles and said ferrule, a spacer member positioned within said tubular ferrule at a spaced position from said inner surface of said skirt, said bristles being held in oriented condition between said inner surface and said spacer member, said spacer member being located at a position inset from said first end of said ferrule, and said inner surface of said skirt being sloped inwardly away from said handle to provide increased engagement of said ribs and grooves with said bristles in the area where said bristles extend outwardly from said first end of said ferrule.

3. A paint brush comprising a tubular sheet metal ferrule, and a bristle body consisting of longitudinally extending bristles, said ferrule having a first end surrounding said bristles and a second end for attachment to a paint brush handle, a skirt at said first end of said ferrule having an inner surface engageable with said bristles, said skirt being serrated at the axial outer end thereof to provide plural ribs and grooves on said inner surface of said skirt at the end of said ferrule furthest from said handle, said plural ribs and grooves extending in a direction longitudinally of said ferrule and engaging said bristles for orienting said bristles where said bristles exit from the first end of said ferrule and preventing the formation of gaps between said bristles and said first end of said ferrule.

4. The paint brush of claim 3 wherein a spacer member is positioned within said ferrule in spaced relation from said inner surface of said skirt, said bristles being held in oriented condition between said inner surface and said space member.

5. The paint brush of claim 4 wherein said spacer member is located at a position inset from said first end of said ferrule.

6. The paint brush of claim 4 wherein the ends of said bristles located in said ferrule are bonded together by an adhesive material, and said spacer member and said bristle body are adhered to said ferrule by said adhesive material providing a unitary construction.

* * * * *